United States Patent [19]

Satoh et al.

[11] 4,295,944

[45] Oct. 20, 1981

[54] ELECTROLYSIS OF AQUEOUS SOLUTION OF ALKALI METAL CHLORIDE

[75] Inventors: Takao Satoh; Toru Seita, both of Shin-nanyo, Japan

[73] Assignee: Toyo Soda Manufacturing Co., Ltd., Shin-nanyo, Japan

[21] Appl. No.: 166,787

[22] Filed: Jul. 8, 1980

[30] Foreign Application Priority Data

Sep. 11, 1979 [JP] Japan ..... 54-115659

[51] Int. Cl.[3] ..... C25B 1/34

[52] U.S. Cl. ..... 204/98; 204/128

[58] Field of Search ..... 204/98, 128

[56] References Cited

U.S. PATENT DOCUMENTS 4,065,367 12/1977 De Nora ..... 204/128

4,792,725 3/1980 Dotson et al. ..... 204/128

FOREIGN PATENT DOCUMENTS 53-93799 11/1978 Japan .

*Primary Examiner*—R. L. Andrews

*Attorney, Agent, or Firm*—Oblon, Fisher, Spivak, McClelland & Maier

[57] ABSTRACT

An alkali metal hydroxide and hydrogen in a cathode compartment and chlorine in an anode compartment by feeding an aqueous solution of an alkali metal chloride in said anode compartment which is partitioned from said cathode compartment with a cation exchange membrane made of a fluorinated polymer is produced under a condition that a temperature of said anode compartment is kept at lower than a temperature of said cathode compartment in said electrolysis.

9 Claims, 2 Drawing Figures

FIG. 1
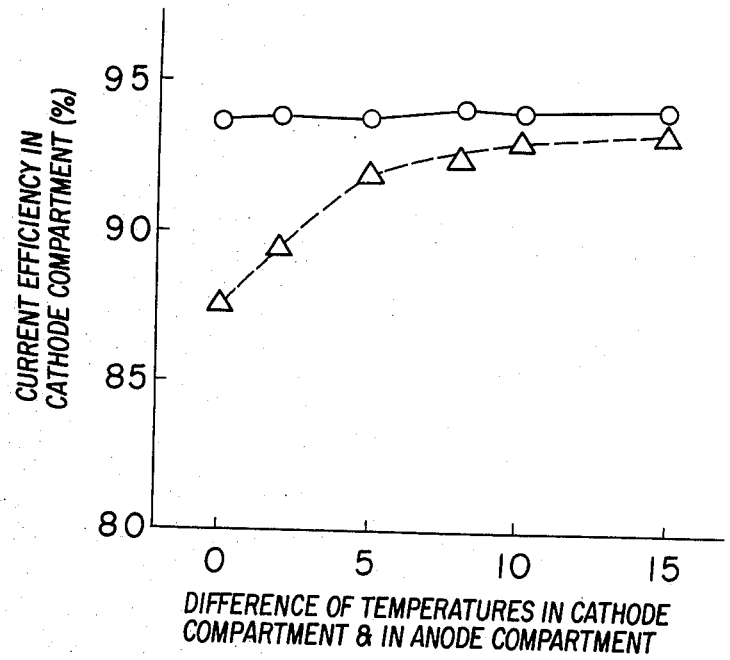
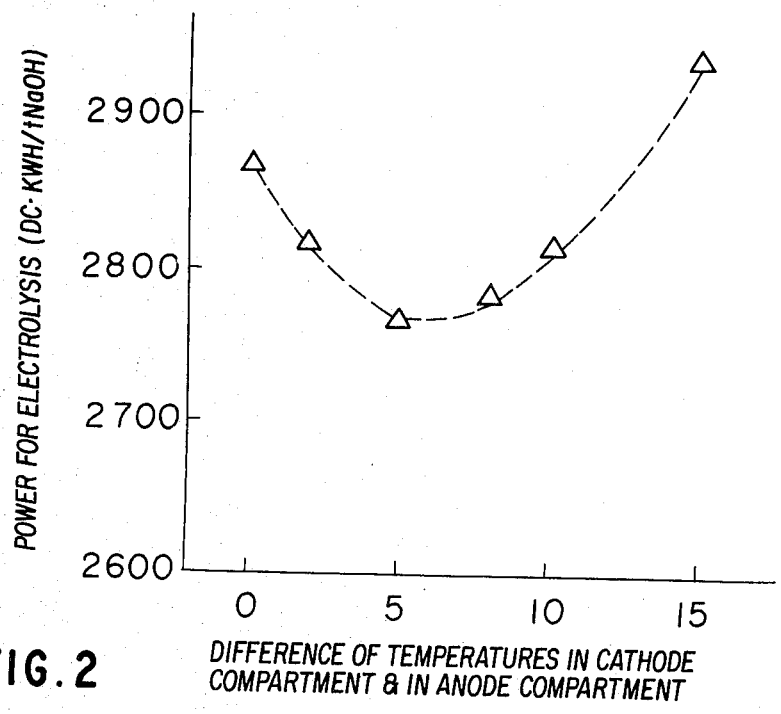
FIG. 2

ELECTROLYSIS OF AQUEOUS SOLUTION OF ALKALI METAL CHLORIDE

BACKGROUND OF THE INVENTION

1. Field of the Invention

The present invention relates to a novel electrolysis for producing an alkali metal hydroxide at high yield and high current efficiency for a long time in an electrolysis of an aqueous solution of an alkali metal chloride with a cation exchange membrane. More particularly, it relates to an electrolysis for producing chloride in an anode compartment and hydrogen and an alkali metal hydroxide in a cathode compartment by partitioning the anode compartment from the cathode compartment with a cation exchange membrane and feeding an aqueous solution of an alkali metal chloride into the anode compartment, especially it relates to an electrolysis of an aqueous solution of sodium chloride to produce sodium hydroxide at high efficiency for a long time.

2. DESCRIPTION OF THE PRIOR ART

It has been known for a long time to electrolyze an aqueous solution of an alkali metal chloride with a selective cation exchange membrane. Recently, it has been proposed to electrolyze an aqueous solution of sodium chloride in an industrial scale with a cation exchange membrane made of a fluorinated resin.

in electrolysis with an ion-exchange membrane, the anode compartment and the cathode compartment are partitioned with the ion-exchange membrane and an aqueous solution of sodium chloride is fed into the anode compartment and an aqueous solution of sodium hydroxide is fed into the cathode compartment and the electrolysis is carried thereby producing chlorine in the anode compartment and hydrogen and sodium hydroxide in the cathode compartment. In accordance with the process of the present invention the content of sodium the chloride in sodium hydroxide solution can be substantially decreased. In conventional electrolysis using asbestos as a diaphragm the content of the sodium chloride in sodium hydroxide solution has been too large for use in certain fields. This disadvantage has been overcome.

At the beginning of the development of the electrolysis of sodium chloride by the ion-exchange membrane method, a cation exchange membrane having pendant sulfonic acid groups obtained by hydrolysis of a membrane made of a copolymer of perfluorocarbon sulfonyl fluoride and tetrafluoroethylene was used as the membrane.

In the electrolysis using such ion-exchange membrane, however, hydrophilic property of the sulfonic acid groups is too high whereby control of hydroxyl ions which undergo reverse diffusion from the cathode compartment to the anode compartment is too weak. When the concentration of the alkali metal hydroxide obtained from the cathode compartment is increased, the current efficiency is decreased. In the electrolysis of an aqueous solution of sodium chloride, when sodium hydroxide having a concentration of higher than 20 wt.% is obtained, the current efficiency is substantially low. The application of said method to industry has been disadvantageously difficult.

It has been proposed to use an improved sulfonic acid type cation exchange membrane having different ion-exchange capacity of the sulfonic acid groups at the anode side from that of the cathode side, that is, having a smaller ion-exchange capacity at the cathode side than that of the anode side. When such membrane is used, it is difficult to produce sodium hydroxide having high concentration. Only a small number of industrial operations for producing sodium hydroxide having a concentration of 10 to 20% have been carried out.

In order to overcome the fatal disadvantages for producing sodium hydroxide having high concentration which is caused by high hydrophilic property of sulfonic acid groups of the cation exchange membrane having pendant sulfonic acid groups, it has been proposed to use a cation exchange membrane made of fluorocarbon polymer of a layer having sulfonamide groups as the ion-exchange groups formed by treating the cathode side surface of the membrane having sulfonic acid groups with ethylenediamine, in an electrolysis of an aqueous solution of an alkali metal chloride as disclosed in Japanese Unexamined Patent Publication No. 92339/1975 and 96987/1977. It has been also proposed to use a cation exchange membrane made of perfluorocarbon polymer having sulfonic acid groups and carboxylic acid groups as disclosed in Japanese Unexamined Patent Publication No. 37198/1978.

When an electrolysis is carried out by using the cation exchange membrane made of perfluorocarbon polymer having weak cation exchange groups such as sulfonamide groups and carboxylic acid groups, the activity for reducing hydroxyl ions which undergo reverse diffusion from the cathode compartment is larger than that of the membrane having sulfonic acid groups, whereby an alkali metal hydroxide solution having high concentration can be obtained at high current efficiency.

The membrane having sulfonamide groups or carboxylic acid groups has the above-mentioned advantages whereas it has a disadvantage of high electric resistance as a low electric conductivity. It is usual to form the layer having said weak acidic cation exchange groups at the cathode side of said cation exchange membrane and to form the layer having sulfonic acid groups as main ion-exchange groups at the anode side.

It is also known that a cation exchange membrane formed by fabricating a terpolymer of $CF_2{=}CF_2$, $CF_2{=}CF{-}O{-}CF_3$ and $CF_2{=}CF{-}O{-}CF_2)_3COOCH_3$ and hydrolyzing it to form carboxylic acid groups is a desired membrane for producing an alkali metal hydroxide having high concentration at high current efficiency.

The inventors have studied an electrolysis of an aqueous solution of sodium chloride by using the conventional cation exchange membrane having weak cation exchange groups such as sulfonamide groups or carboxylic acid groups at the cathode side. As a result, serious problems have been found because even though an alkali metal hydroxide having a high concentration such as 20 to 35% can be produced at a high current efficiency of higher than 90% by using such cation exchange membrane (this fact could not be expected by using the cation exchange membrane having sulfonic acid groups), the high current efficiency gradually diminishes during long periods of operation.

The descrease of a current efficiency is the serious problem since it causes a decrease in production of sodium hydroxide and the balance of movement of ions in the electrolytic cell is changed which causes problems in the operation of the electrolytic cell such as the control of the concentration of sodium hydroxide in the cathode compartment, pH control in the anode compartment, control of by-product chlorate production and control of oxygen concentration in chlorine, as considered by a person skilled in the art.

SUMMARY OF THE INVENTION

It is an object of the present invention to provide a process for producing an alkali metal hydroxide at high current efficiency for a long time under producing a change of the current efficiency in an electrolysis using a cation exchange membrane having weak acid cation exchange groups such as sulfonamide groups or carboxylic acid groups at the cathode side of the membrane.

The foregoing and other objects of the present invention have been attained by providing an electrolysis for producing an alkali metal hydroxide and hydrogen in a cathode compartment and chlorine in an anode compartment by feeding an aqueous solution of an alkali metal chloride in said anode compartment which is partitioned from said cathode compartment with a cation exchange membrane made of a fluorinated polymer having weak acidic cation exchange groups of sulfonamide groups or carboxylic acid groups at said cathode side wherein a temperature in said anode compartment is kept at lower than that of said cathode compartment.

BRIEF DESCRIPTION OF THE DRAWINGS

FIG. 1 shows a relation of a current efficiency for sodium hydroxide in the cathode compartment and difference of temperatures in the cathode compartment and in the anode compartment; and FIG. 2 shows a relation of power for electrolysis and difference of temperatures in the cathode compartment and in the anode compartment.

DETAILED DESCRIPTION OF THE PREFERRED EMBODIMENTS

The temperatures in the cathode compartment and the anode compartment means the temperatures of the solutions in the compartments which are the temperatures near the outlets of the compartment. It is usual to measure the temperatures by inserting each temperature measuring element near each outlet of each compartment of the electrolytic cell.

In accordance with the present invention, the temperature in the anode compartment is kept at 3° to 10° C. lower than the temperature of the cathode compartment in the electrolysis whereby the high current efficiency can be maintained for a long time.

In FIG. 1, the difference of temperatures in the cathode compartment and in the anode compartment is plotted on the abscissa and the current efficiency for sodium hydroxide in the cathode compartment is plotted on the ordinate. A cation exchange membrane having sulfonamide groups at the cathode side (Nafion 295 manufactured by I. E. DuPont) is used. The electrolysis is carried out at a current density of 30 A/dm$^2$, a concentration of sodium hydroxide of 29 wt.% in the cathode compartment and a temperature of 85° C. in the cathode compartment.

The full line shows the current efficiency in the electrolysis under the differences of the temperatures after 30 days from the initiation of the electrolysis. The broken line shows the current efficiency after 200 days from the initiation of the electrolysis.

As it is understood from FIG. 1, the decrease of the current efficiency after 30 days or 200 days is 6% in the case of zero of the difference of the temperatures in the cathode compartment and in the anode compartment. It is only 2% in the case of 5° C. of the difference of the temperatures. The rate of the decrease of the current efficiency is lower depending upon increasing the difference of the temperature. The high current efficiency can be maintained for a long time.

In FIG. 2, the difference of temperatures in the cathode compartment and in the anode compartment is plotted on the abscissa and the power for electrolysis obtained from the current efficiency for sodium hydroxide and the cell voltage is plotted on the ordinate.

As it is understood from FIG. 2, it is economical to maintain the temperature in the anode compartment to be 3° to 10° C. preferably 4° to 8° C. lower than the temperature in the cathode compartment.

In accordance with the present invention, the electrolysis is carried out under maintaining the temperature in the anode compartment to be 3° to 10° C. preferably 4° to 8° C. lower than the temperature in the anode compartment to provide the novel electrolysis of an aqueous solution of an alkali metal chloride by using a cation exchange membrane to produce an alkali metal hydroxide with economical advantages under maintaining high current efficiency for a long time.

In the electrolysis of an aqueous solution of sodium chloride for a long time by using a cation exchange membrane, the current efficiency is decreased by a long operation and the decrease of the current efficiency can be minimized by maintaining the temperature in the anode compartment lower than the temperature in the cathode compartment and the economical merit in the total consideration is given by the long maintenance of high current efficiency by maintaining the temperature in the anode compartment to be 3° to 10° C. preferably 4° to 8° C. lower than the temperature in the cathode temperature though a disadvantage of increase of the cell voltage is found. These facts have been found by the inventors.

The above-mentioned effect is found in the case of any cation exchange membrane used in the present invention. It is especially remarkable to impart the above-mentioned effect of the present invention by using a complex type cation exchange membrane such as a perfluorocarbon polymer membrane having a layer of sulfonamide groups at the cathode side and a layer of sulfonic acid groups at the anode side; or a perfluorocarbon polymer membrane having a layer of carboxylic acid groups at the cathode side and a layer of sulfonic acid groups at the anode side; or a perfluorocarbon polymer membrane having a layer of sulfonamide groups at the cathode side, a layer of sulfonic acid groups at the anode side and a middle layer of carboxylic acid groups as three layer structure.

It is also effective to use a cation exchange membrane obtained by fabricating a terpolymer of $CF_2{=}CF_2$, $CF_2{=}CF{-}O{-}CF_3$, and $CF_2{=}CF{-}O{-}CF_2)_3COOCH_3$ in a form of a membrane and hydrolyzing it.

The structure of the electrolytic cell is not critical and can be a monopolar system or a bipolar system. The anode can have a form of a plate or a porous plate which is placed in the anode compartment partitioned with the cation exchange membrane in the electrolytic cell. The substance for the anode can be electroconductive substances which resist to an anolyte and it is usually a titanium substrate coated with a platinum group metal or a platinum group metal oxide.

The cathode can have a form of a plate or a porous plate which is placed in the cathode compartment. The substance for the cathode is preferably iron, nickel or an iron substrate coated with a nickel compound.

The anode compartment and the cathode compartment of the electrolytic cell are respectively made of substances which resist to the solution in each compartment. In usual, the inner surface of the anode compartment is coated with titanium and the cathode compartment is made of iron. The anode compartment has an inlet for an aqueous solution of an alkali metal chloride and an outlet for chlorine and an outlet for a dilute aqueous solution of an alkali metal chloride. The cathode compartment has an outlet for hydrogen gas generated in the cathode and an outlet for an aqueous solution of an alkali metal hydroxide, an inlet for water or a dilute aqueous solution of an alkali metal hydroxide fed into the cathode compartment.

As the typical method of electrolyzing it under maintaining the temperature in the anode compartment to be 3° to 10° C. preferably 4° to 8° C. lower than the temperature in the cathode compartment in the present invention, a whole or part of the aqueous solution of an alkali metal chloride in the anode compartment is recycled and a cooling means is equipped in the recycling system or a whole or part of the aqueous solution of an alkali metal hydroxide in the cathode compartment is recycled and a heating means is equipped in the recycling system. Both means can be also combined.

In the electrolysis of an aqueous solution of an alkali metal chloride by using the cation exchange membrane, the effect of the present invention can be expected by the conditions of the electrolysis of a current density of 10 to 50 A/dm$^2$; a concentration of an alkali metal hydroxide of 10 to 40 wt.% in the cathode compartment and a concentration of an alkali metal chloride of 2.5 to 5 N in the anode compartment. The temperature in the cathode compartment is preferably in a range of 70° to 95° C. The temperature in the anode compartment is to be 3° to 10° C. lower than the temperature in the cathode compartment.

The present invention will be further illustrated by certain examples and references which are provided for purposes of illustration only and are not intended to be limiting the present invention.

EXAMPLE 1

A two compartment type vertical electrolytic cell comprised lines for recycling a part of sodium hydroxide and a part of sodium chloride respectively from the electrolytic cell to a cathode compartment and an anode compartment and a heat-exchanger in said lines and said electrolytic cell had a fluorinated polymer cation exchange membrane having an effective area of 6 dm$^2$ and having a layer having sulfonamide groups treated with ethylenediamine at a cathode side and a layer having sulfonic acid groups at an anode side. An electrolysis of an aqueous solution of sodium chloride was carried out in said electrolytic cell under a condition of a current of 180 ampere, a concentration of sodium hydroxide of 29 wt.% in the cathode compartment and a concentration of sodium chloride of 4.3 N-NaCl in the anode compartment.

The temperature at the outlet of the cathode compartment was kept at 80° C. by using a temperature controller formed by combining the heat-exchanger and a temperature measuring resistor inserted near the outlet of the cathode compartment. On the other hand, the temperature at the outlet of the anode compartment was kept at 75° C. using a similar temperature controller. The electrolysis was carried out in the temperature condition.

After 30 days from the initiation of the electrolysis, a current efficiency for producing sodium hydroxide in the cathode compartment was 93.3% and after 200 days, it was 91.6% and a cell voltage was 3.90 volts.

As a reference, an electrolysis was carried out under a temperature control at the outlets of the anode compartment and the cathode compartment of 80° C. After 30 days from the initiation of the electrolysis, a current efficiency was 93.5% but after 200 days, it was 88.3% and a cell voltage was 3.85 volts.

In comparison with electric powers for electrolyses after 200 days, the former was 2,853 DC.KWH/t.NaOH which was advantageous over the latter of 2,921 DC.KWH/t.NaOH.

EXAMPLES 2 to 4

A membrane of a copolymer of $CF_2{=}CF_2$ and $$CF_2{=}CF{-}O{-}CF_2{-}\underset{\underset{CF_3}{|}}{CF}{-}O{-}CF_2{-}CF_2{-}SO_2F$$

(EW=1200 and thickness of 7 mils) was reinforced with polytetrafluoroethylene fiber and was hydrolyzed and treated with 1 N-HCl to convert the ion-exchange groups to be acid form. The membrane was treated with a mixture of phosphorus oxychloride and phosphorus pentachloride (1:1 by weight) at 120° C. for 50 hours and then, it was washed with carbon tetrachloride and dried to convert sulfonic acid groups into sulfonyl chloride groups. The sulfonyl chloride groups were confirmed by the surface infrared spectrum. Only one surface of said membrane was treated with 57% aqueous solution of hydrogen iodide to convert sulfonyl chloride groups into carboxylic acid groups. According to a coloring test, the layer of the carboxylic acid groups had a thickness of 1.3 mils. The unreacted sulfonyl chloride groups were converted into sulfonic acid groups by hydrolysis and the ion-exchange groups of the membrane were converted into acid type with 1 N-HCl.

In the electrolytic cell of Example 1 using said membrane, an electrolysis of an aqueous solution of sodium chloride was carried out.

In the condition of the electrolysis, a current was 180 amp. and a rate of water fed into the cathode compartment and a rate of an aqueous solution of sodium chloride fed into the anode compartment were controlled so as to be a concentration of sodium hydroxide of 32% in the cathode compartment and a concentration of sodium chloride of 3.8 N in the anode compartment.

The temperature at the outlet of the heat exchanger for the recycled sodium hydroxide was controlled to be the temperature of sodium hydroxide of 85° C. at the outlet of the cathode compartment. The temperature of the aqueous solution of sodium chloride fed into the anode compartment was controlled to be the temperature of 82°, 80° or 77° C. at the outlet of the anode compartment. The electrolyses were respectively carried out in said conditions.

The current efficiencies of sodium hydroxide in the cathode compartment and the cell voltages and data after 30 days or 150 days from the initiation of the electrolysis and the required powers for the electrolyses are shown in Table 1.

REFERENCES 1 and 2

In accordance with the process of Examples 2 to 4 except controlling the temperature at the outlet of the anode compartment to 85° C. or 70° C., each electrolysis of an aqueous solution of sodium chloride was carried out in the same condition by using the same cation exchange membrane.

The current efficiencies for sodium hydroxide in the cathode compartment and the cell voltages after 30 days or 150 days from the initiation of the electrolysis and the required powers for the electrolysis are shown in Table 1.

As it is found in Table 1, when the electrolysis was carried out under maintaining the temperature of the anode compartment to be 3° to 8° C. lower than the temperature of the cathode compartment (Examples 2 to 4), the required powers for electrolysis after 150 days were remarkably smaller than the required powers for electrolysis without any difference of the temperature (Reference 1) or with a difference of 15° C. (Reference 2). The effect of the present invention is clearly found.

TABLE 1

| | Ref. 1 | Exp. 2 | Exp. 3 | Exp. 4 | Ref. 2 |
|---|---|---|---|---|---|
| Temp. of cathode compartment (°C.) | 85 | 85 | 85 | 85 | 85 |
| Temp. of anode compartment (°C.) | 85 | 82 | 80 | 77 | 70 |
| Days after the initiation of electrolysis (days) | 30<br>150 | 30<br>150 | 30<br>150 | 30<br>150 | 30<br>150 |
| Current efficiency (%) | 94.2<br>90.0 | 94.3<br>92.0 | 94.2<br>92.9 | 94.4<br>93.8 | 94.5<br>94.0 |
| Cell voltage (volt) | 3.84<br>3.85 | 3.86<br>3.86 | 3.87<br>3.88 | 3.93<br>3.94 | 4.18<br>4.18 |
| Required power for electrolysis DC-KWH/t.-NaOH | 2,731<br>2,866 | 2,742<br>2,811 | 2,753<br>2,784 | 2,789<br>2,814 | 2,964<br>2,979 |

EXAMPLE 5

A membrane of a terpolymer of $CF_2{=}CF_2$, $CF_2{=}CF{-}O{-}CF_2$ and $CF_2{=}CF{-}O{-}CF_2)_3COOCH_3$ was hydrolyzed to obtain a cation exchange membrane having an ion-exchange capacity of 1.2 meq/g. dry resin and a thickness of 0.2 mm.

The cation exchange membrane was equipped in the electrolytic cell of Example 1 and an electrolysis of an aqueous solution of sodium chloride was carried out.

In the condition of the electrolysis, a current was 150 amp. and a rate of water fed into the cathode compartment and a rate of an aqueous solution of sodium chloride fed into the anode compartment were controlled so as to be a concentration of sodium hydroxide of 39 wt.% in the cathode compartment and a concentration of sodium chloride of 4.0 N in the anode compartment.

The temperature of the recycled sodium hydroxide and the temperature of the aqueous solution of sodium chloride were controlled as those of Example 1 so as to be a temperature of sodium hydroxide of 90° C. at the outlet of the cathode compartment and the temperature of the aqueous solution of sodium chloride of 84° C. at the outlet of the anode compartment in the electrolysis of the aqueous solution of sodium chloride.

After 30 days from the initiation of the electrolysis, a current efficiency for sodium hydroxide was 94.7%. After 180 days from the initiation of the electrolysis, the current efficiency was 94.2% and the cell voltage was 3.97 volt. The required power for electrolysis was 2,824 DC.KWH/t.NaOH.

As a reference, the temperatures at the outlet of the cathode compartment and the outlet of the anode compartment were controlled to be 90° C. in the electrolysis of the aqueous solution of sodium chloride. After 30 days from the initiation of the electrolysis, a current efficiency for sodium hydroxide was 94.5%. After 180 days, the current efficiency was 92.5% and the cell voltage was 3.95 volt and the required power for electrolysis was 2,861 DC.KWH/t.NaOH.

We claim:

1. In a method for electrolyzing an aqueous alkali metal chloride solution by feeding said solution into a cell containing a cathode compartment and an anode compartment partitioned by a cation exchange membrane fabricated from a fluorinated polymer having weakly acidic groups on the cathode side of said cell, and electrolyzing said solution thereby generating an alkali metal hydroxide and hydrogen in the cathode compartment and chlorine in the anode compartment, the improvement comprising:

conducting said electrolysis under conditions in which the temperature of the anode compartment is kept lower then the temperature of the cathode compartment.

2. The method of claim 1, wherein the difference in temperature between said compartments is such that the temperature of the anode compartment is from 3° C. to 10° C. less than that of the cathode compartment.

3. The method of claim 2, wherein said temperature range is a difference of from 4° C. to 8° C.

4. The method of claim 1, wherein said cation exchange membrane is obtained by fabricating a terpolymer of $CF_2{=}CF_2$, $CF_2{=}CFOCF_3$ and $CF_2{=}CF{-}O{-}(CF_2)_3{-}CO_2CH_3$ and hydrolyzing the ester groups in said terpolymer.

5. The method of claim 1, wherein said weakly acidic groups are carboxylic acid groups or sulfonamide groups.

6. The method of claim 1, wherein said electrolysis is conducted at a current density of 10 to 50 $A/dm^2$.

7. The method of claim 1, wherein the concentration of alkali metal hydroxide in said cathode compartment ranges from 10 to 40 wt. %.

8. The method of claim 1, wherein the concentration of said alkali metal chloride solution ranges from 2.5 to 5 N.

9. The method of claim 1, wherein the temperature of said cathode compartment ranges from 70° to 95° C.

* * * * *